US010460890B2

(12) United States Patent
Zimmer

(10) Patent No.: US 10,460,890 B2
(45) Date of Patent: Oct. 29, 2019

(54) MULTI-POLE DOME SWITCH

(71) Applicant: Trent Zimmer, Houma, LA (US)

(72) Inventor: Trent Zimmer, Houma, LA (US)

( * ) Notice: Subject to any disclaimer, the term of this patent is extended or adjusted under 35 U.S.C. 154(b) by 0 days.

(21) Appl. No.: 16/006,790

(22) Filed: Jun. 12, 2018

(65) Prior Publication Data

US 2018/0358191 A1 Dec. 13, 2018

Related U.S. Application Data

(60) Provisional application No. 62/519,111, filed on Jun. 13, 2017.

(51) Int. Cl.

| | |
|---|---|
| ***H01H 13/64*** | (2006.01) |
| ***H01H 13/14*** | (2006.01) |
| ***H01H 13/52*** | (2006.01) |
| *H01H 13/803* | (2006.01) |

(52) U.S. Cl.

CPC ..... *H01H 13/14* (2013.01); *H01H 13/52* (2013.01); *H01H 13/64* (2013.01); *H01H 13/803* (2013.01); *H01H 2203/024* (2013.01); *H01H 2203/038* (2013.01); *H01H 2205/004* (2013.01); *H01H 2211/036* (2013.01); *H01H 2215/01* (2013.01); *H01H 2215/016* (2013.01); *H01H 2215/018* (2013.01); *H01H 2215/024* (2013.01); *H01H 2225/006* (2013.01); *H01H 2225/01* (2013.01); *H01H 2227/022* (2013.01); *H01H 2227/0261* (2013.01)

(58) Field of Classification Search

CPC ..... H01H 13/48; H01H 2215/004; H01H 13/702; H01H 2205/016; H01H 13/52; H01H 2013/525; H01H 2215/036; H01H 2227/026; H01H 2227/022; H01H 2215/012; H01H 13/14; H01H 13/64; H01H 2215/024; H01H 2215/016; H01H 2203/038; H01H 13/803; H01H 2227/0261; H01H 2225/006; H01H 2215/01; H01H 2215/018; H01H 2211/036; H01H 2205/004; H01H 2225/01

USPC ..... 200/406, 513, 516, 275

See application file for complete search history.

(56) References Cited

U.S. PATENT DOCUMENTS

| | | | |
|---|---|---|---|
| 3,996,429 | A | 12/1976 | Chu et al. |
| 4,987,275 | A | 1/1991 | Miller et al. |
| 5,824,978 | A | 10/1998 | Karasik et al. |

(Continued)

*Primary Examiner* — Ahmed M Saeed

(74) *Attorney, Agent, or Firm* — Asgaard Patent Services, LLC; F. Wayne Thompson, Jr.

(57) ABSTRACT

Implementations of a multi-pole dome switch configured to simultaneously, or nearly simultaneously, close or open two separate circuits are provided. In some implementations, a multi-pole dome switch may comprise a tactile metal dome and a conductive insert that are separated by an insulator. In some implementations, when the dome is depressed, the dome and the conductive insert are configured to simultaneously, or nearly simultaneously, make conductive contact with two traces of a first circuit and two traces of a second circuit, respectively, positioned thereunder on a PCB. In this way, the multi-pole dome switch is able to simultaneously, or nearly simultaneously, close two separate circuits. Succinctly put, in some implementations, the multi-pole dome switch may be configured to act as a double-pole, double-throw switch.

20 Claims, 9 Drawing Sheets

(56) References Cited

U.S. PATENT DOCUMENTS

| | | | | |
|---|---|---|---|---|
| 6,423,918 | B1 * | 7/2002 | King | H01H 13/48 200/406 |
| 6,936,777 | B1 * | 8/2005 | Kawakubo | H01H 13/48 200/1 B |
| 7,652,216 | B2 | 1/2010 | Sharrah et al. | |

* cited by examiner

MULTI-POLE DOME SWITCH

CROSS REFERENCE TO RELATED APPLICATION

This application claims the benefit of U.S. Provisional Application Ser. No. 62/519,111, which was filed on Jun. 13, 2017, and is incorporated herein by reference in its entirety.

TECHNICAL FIELD

This disclosure relates to implementations of a multi-pole dome switch.

BACKGROUND

A dome switch, or dome, configured to be mounted on a printed circuit board (PCB), a flex circuit, or a membrane is well known in the prior art. Each dome switch may be secured to a mounting substrate (e.g., a PCB) by an adhesive. To increase the actuation force of a single switch, two domes may be stacked in a single position on the mounting substrate. When depressed, a dome switch may be configured to make contact with two traces and thereby close (or complete) a single circuit. Therefore, two dome switches would be required to close two separate circuits.

However, using two dome switches to independently close two separate circuits has several disadvantages. First, the overall bulk of an electronic device increases as the number of dome switches increases. Second, since two prior art dome switches cannot be co-mounted, actuating two separate electronic devices by depressing a single switch is not possible.

A prior art solution for a single switch that can simultaneously close two separate circuits is a double-pole, double-throw (DPDT) rocker switch. Unfortunately, DPDT switches are too bulky for many applications.

Accordingly, it can be seen that needs exist for the multi-pole dome switch disclosed herein. It is to the provision of a multi-pole dome switch configured to address these needs, and others, that the present invention in primarily directed.

SUMMARY OF THE INVENTION

Implementations of a multi-pole dome switch are provided. In some implementations, a single multi-pole dome switch may be configured to simultaneously, or nearly simultaneously, close or open two circuits. In this way, for example, two separate electrical devices may be simultaneously, or nearly simultaneously, turned on or off.

In some implementations, a multi-pole dome switch may be disposed upon a printed circuit board (PCB) that includes a first trace, a second trace, a third trace, and a fourth trace. In some implementations, the first trace and the second trace may be portions of a first open circuit; the third trace and the fourth trace may be portions of a second open circuit.

In some implementations, a multi-pole dome switch may comprise a tactile metal dome and a conductive insert that are separated by an insulator. In some implementations, the insulator may be configured and positioned to prevent a short circuit between the dome and the conductive insert.

In some implementations, when the dome is depressed, the dome and the conductive insert may be configured to simultaneously, or nearly simultaneously, make conductive contact with the first and second traces and the third and fourth traces, respectively, positioned on the PCB. In this way, the multi-pole dome switch is able to simultaneously, or nearly simultaneously, close two separate circuits. Succinctly put, in some implementations, the multi-pole dome switch may be configured to act as a double-pole, double-throw switch.

In some implementations, the dome may comprise four legs, a centrally located bore that extends therethrough, and a downwardly curved contact portion.

In some implementations, each leg of the dome may be secured to the PCB in a manner that places them in conductive contact with the first trace thereof. While a four-leg metal dome is described, it should be understood that other domes (e.g., circular, triangle, oblong, and/or custom metal domes) may be used.

In some implementations, the downwardly curved contact portion may be an annular feature that encircles the bore extending through the dome. In some implementations, the downwardly curved contact portion may be configured to make contact with the second trace located on the PCB when the dome is depressed. In this way, the dome is able to conductively connect the first and second traces and thereby close the first circuit.

In some implementations, the centrally located bore of the dome may be configured so that a conductive portion (or contact) of a downwardly extending cylindrical feature of the conductive insert can extend therethrough. In this way, when the dome is depressed, the contact of the conductive insert is able to conductively connect the third and fourth traces of the PCB and thereby close the second circuit.

In some implementations, the conductive insert may comprise a centrally located contact portion and an annular flange.

In some implementations, the contact portion may be a bottom portion of the downwardly extending cylindrical feature of the conductive insert. In some implementations, the contact portion of the conductive insert may be any shape suitable for making conductive contact with the third and fourth traces on the PCB when the dome is depressed. In this way, the contact portion of the conductive insert may be used to close the second circuit.

In some implementations, the insulator may be positioned and configured to prevent contact between the dome and the conductive insert. In some implementations, the insulator may comprise an annular flange and a centrally located bore defined by a downwardly extending lip.

In some implementations, the centrally located bore of the insulator may be configured to be in coaxial alignment with the bore of the dome when positioned thereon. In this way, the contact portion of the downwardly extending cylindrical feature of the conductive insert may extend therethrough.

In some implementations, the annular flange of the insulator may be larger in diameter than the annular flange of the conductive insert. In this way, the insulator may be configured to prevent a short circuit between the dome and the annular flange of the conductive insert.

In another example implementations, the conductive insert and the insulator of a multi-pole dome switch may be a single unitary piece formed using an overmolding process. In some implementations, the conductive insert may be a circular contact area positioned on the underside of the insulator so that it extends into and through the bore of the dome. In this way, the contact area of the conductive insert is able to conductively connect two traces positioned thereunder when the dome is depressed.

In yet another example implementation, a multi-pole dome switch may comprise a first dome and a second dome separated by a non-conductive tape (e.g., a pressure sensitive adhesive tape). In some implementations, the non-conductive tape may be configured and positioned to prevent conductive contact between the first dome and the second dome of a multi-pole dome switch.

In some implementations, when the second dome is depressed, the first dome and the second dome may be configured to simultaneously, or nearly simultaneously, make conductive contact with a first pair of traces and a second pair of traces, respectively, positioned thereunder on a PCB. In this way, the multi-pole dome switch is able to simultaneously, or nearly simultaneously, close two separate circuits.

In some implementations, the second dome comprises four legs and a centrally located downward protrusion configured to extend through the centrally located bore of the first dome. In some implementations, while the second dome is depressed, the downward protrusion thereof may be configured to make conductive contact with two traces and thereby close a circuit.

In some implementations, when the multi-pole dome switch is assembled, a bore extending though the non-conductive tape may be in coaxial alignment with the bore extending through the first dome. In this way, when the domes are depressed, the downward protrusion of the second dome is able to extend through the bore of the non-conductive tape and the bore of the first dome to make conductive contact with two traces and thereby close a circuit.

DETAILED DESCRIPTION

FIGS. 1A-1D illustrate an example multi-pole dome switch 100 according to the principles of the present disclosure. In some implementations, a single multi-pole dome switch 100 may be configured to simultaneously, or nearly simultaneously, close or open two circuits. In this way, for example, two separate electrical devices may be simultaneously, or nearly simultaneously, turned on or off.

Figure 1A:
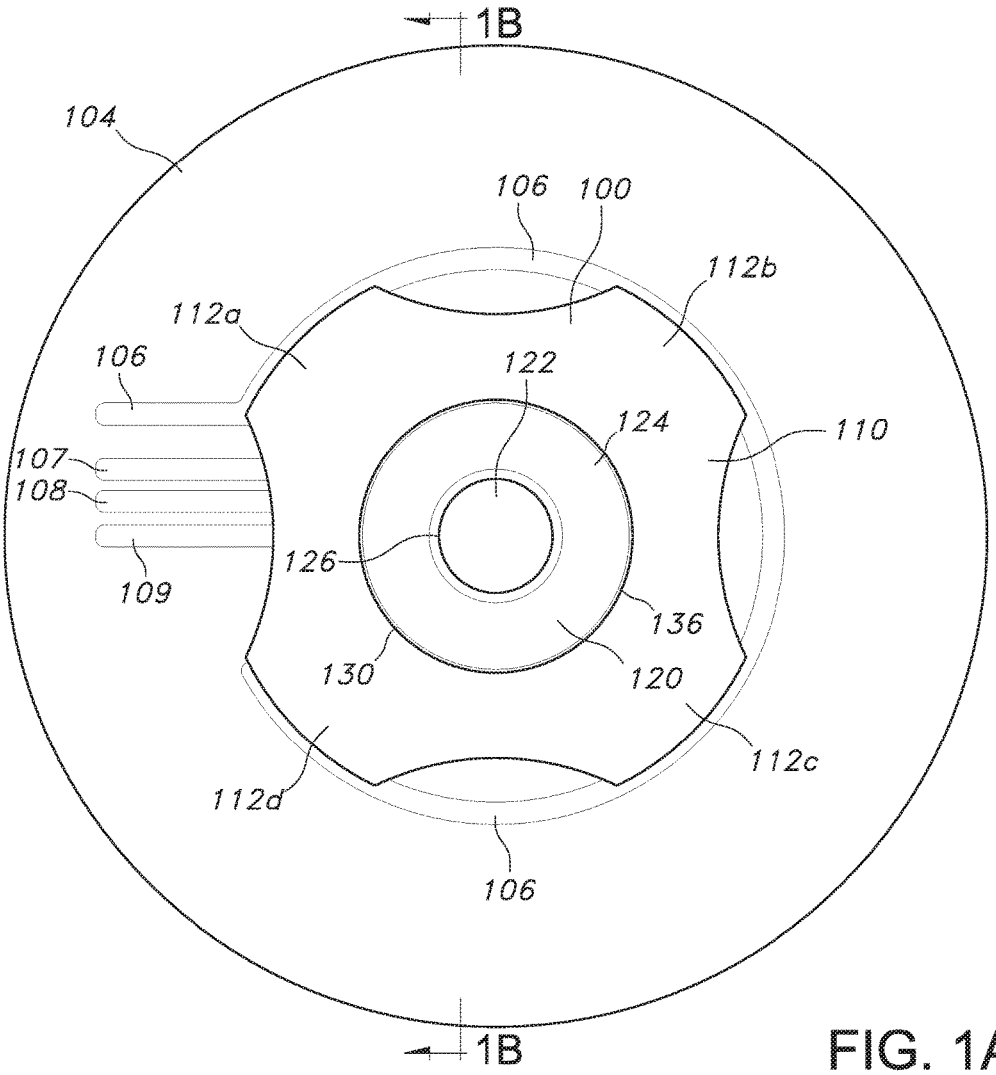
FIG. 1A illustrates a top plain view of an example implementation of a multi-pole dome switch according to the principles of the present disclosure.
Figure 1B:
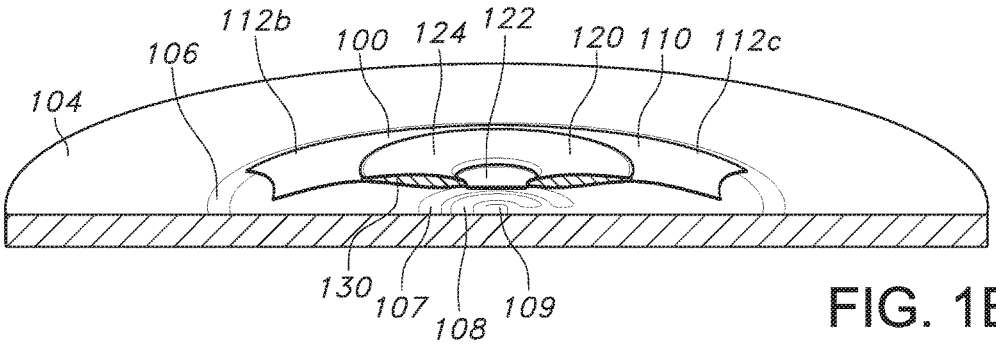
FIGS. 1B-1D illustrate cross-sectional views of the multi-pole dome switch shown in FIG. 1A.

As shown in FIGS. 1A and 1B, in some implementations, a multi-pole dome switch 100 may be disposed upon a printed circuit board (PCB) 104. In some implementations, the PCB 104 may include a first trace 106, a second trace 107, a third trace 108, and a fourth trace 109. In some implementations, the first trace 106 and the second trace 107 may be portions of a first open circuit; the third trace 108 and the fourth trace 109 may be portions of a second open circuit.

As shown in FIGS. 1A and 1B, in some implementations, a multi-pole dome switch 100 may comprise a tactile metal dome 110 and a conductive insert 120 that are separated by an insulator 130. In some implementations, the insulator 130 may be configured and positioned to prevent a short circuit between the dome 110 and the conductive insert 120.

As shown in FIGS. 1A-1D, in some implementations, the dome 110 may comprise four legs 112, a centrally located bore 114 that extends therethrough, and a downwardly curved contact portion 116.

As shown in FIG. 1A, in some implementations, the dome 110 may comprise a first leg 112*a*, a second leg 112*b*, a third leg 112*c*, and a fourth leg 112*d*. In some implementations, the first leg 112*a*, the second leg 112*b*, the third leg 112*c*, and/or the fourth leg 112*d* may be secured to the PCB 104 in a manner that places it in conductive contact with the first trace 106 thereof. In this way, each leg 112*a*-112*d* of the dome 110 may be configured (e.g., positioned) to act as an electrical contact. While a four-leg dome 110 is shown, it should be understood that other domes (e.g., circular, triangle, oblong, and/or custom metal domes) may be used.

Figure 1C:
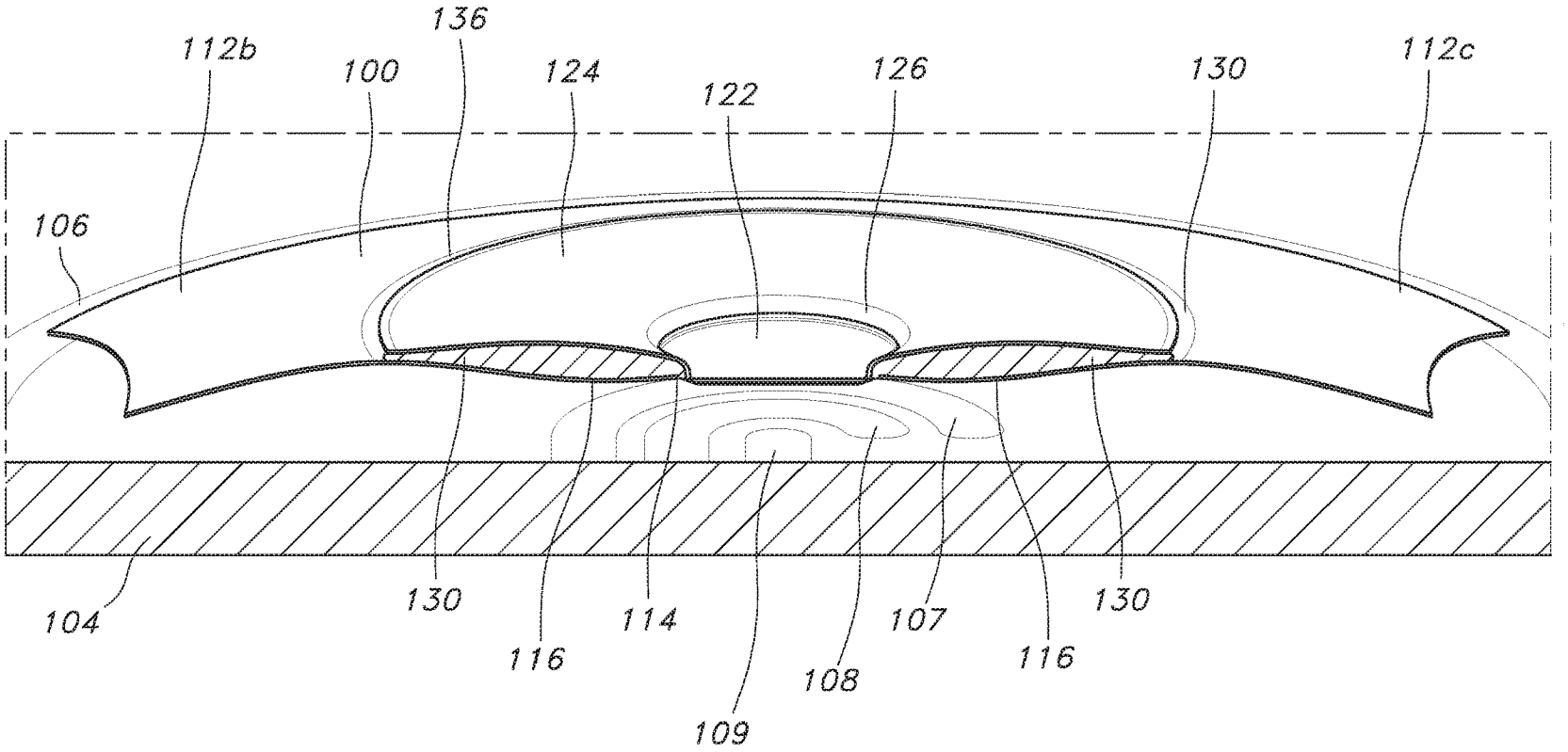

As shown in FIG. 1C, in some implementations, the downwardly curved contact portion 116 of the dome 110 may be located adjacent to the bore 114 thereof. In some implementations, the downwardly curved contact portion 116 may be an annular feature that encircles the bore 114 extending through the dome 110. In some implementations, the downwardly curved contact portion 116 may be configured to make contact with the second trace 107 located on the PCB 104 when the dome 110 is depressed. In this way, the dome 110 is able to conductively connect the first and second traces 106, 107 and thereby close the first circuit.

Figure 1D:
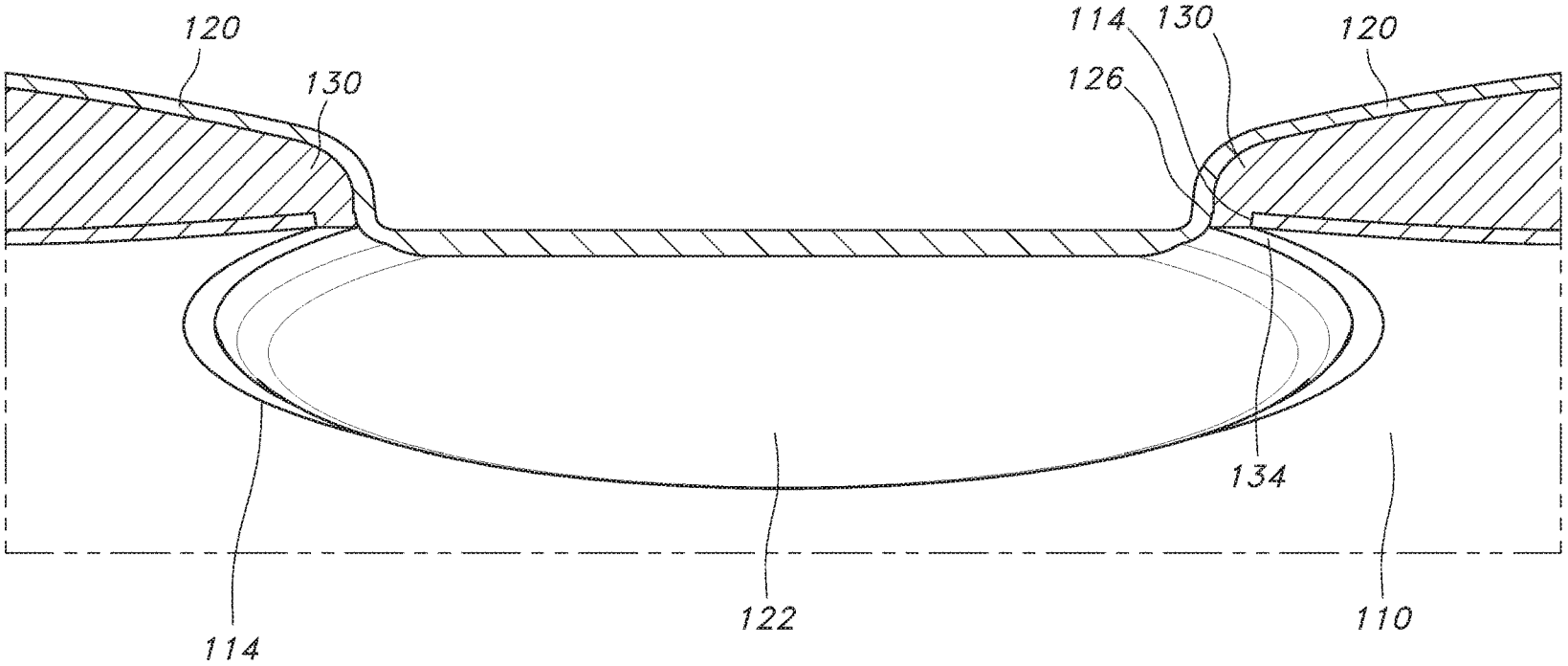

As shown in FIGS. 1C and 1D, in some implementations, the centrally located bore 114 of the dome 110 may be configured so that a conductive portion 122 (or contact) of a downwardly extending cylindrical feature of the conductive insert 120 can extend therethrough. In this way, when the dome 110 is depressed, the contact portion 122 of the conductive insert 120 is able to conductively connect the third and fourth traces 108, 109 of the PCB 104 and thereby close the second circuit.

As shown in FIGS. 1A-1D, in some implementations, the conductive insert 120 may comprise a centrally located contact portion 122 and an annular flange 124.

As shown in FIGS. 1C and 1D, in some implementations, the contact portion 122 may be a bottom portion of the downwardly extending cylindrical feature of the conductive insert 120. In some implementations, the cylindrical feature may comprise a cylindrical side wall 126 that extends between the contact portion 122 and the annular flange 124 of the conductive insert 120 (see, e.g., FIGS. 1A and 1D). In some implementations, the contact portion 122 may be any shape suitable for making conductive contact with the third and fourth traces 108, 109 on the PCB 104 when the dome 110 is depressed. In this way, the contact portion 122 of the conductive insert 120 may be used to close the second circuit.

As shown in FIG. 1A, in some implementations, the annular flange 124 of the conductive insert 120 may be larger in diameter than the bore 114 extending through the dome 110. In this way, the conductive insert 120 may be prevented from falling through the bore 114 of the dome 110.

As shown in FIGS. 1A, 1C, and 1D, in some implementations, the insulator 130 may be positioned and configured to prevent contact between the dome 110 and the conductive insert 120. In some implementations, the insulator 130 may comprise an annular flange 136 and a centrally located bore 132 defined by a downwardly extending lip 134.

As shown in FIG. 1D, in some implementations, the centrally located bore 132 of the insulator 130 may be configured to be in coaxial alignment with the bore 114 of the dome 110 when positioned thereon. In this way, the contact portion 122 of the downwardly extending cylindrical feature of the conductive insert 120 may extend therethrough.

As shown in FIG. 1D, in some implementation, the lip 134 of the insulator 130 may extend into the bore 114 of the dome 110 and thereby be positioned between the cylindrical side wall 126 of the conductive insert 120 and an interior edge of the bore 114. In this way, the lip 134 of the insulator 130 may be used to prevent a short circuit between the dome 110 and the conductive insert 120. In some implementations, the lip 134 may be flush with the underside of the dome 110 adjacent the bore 114 extending therethrough (see, e.g., FIG. 1D). In some implementations, the lip 134 may not be flush with the underside of the dome 110 adjacent the bore 114 extending therethrough (not shown).

As shown in FIGS. 1A and 1C, in some implementations, the annular flange 136 of the insulator 130 may be larger in diameter than the annular flange 124 of the conductive insert 120. In this way, the insulator 130 may be configured to prevent a short circuit between the dome 110 and the annular flange 124 of the conductive insert 120.

In some implementations, a non-conductive tape (e.g., a pressure sensitive adhesive tape) may be used to cover the multi-pole dome switch 100. In this way, the conductive insert 120, insulator 130, and dome 110 of the multi-pole dome switch 100 may be held together as an assembly.

Therefore, in some implementations, when the dome 110 is depressed, the dome 110 and the conductive insert 120 may be configured to simultaneously, or nearly simultaneously, make conductive contact with the first and second traces 106, 107 and the third and fourth traces 108, 109, respectively, positioned on the PCB 104. In this way, a single multi-pole dome switch 100 is able to simultaneously, or nearly simultaneously, close two separate circuits. Succinctly put, in some implementations, the multi-pole dome switch 100 may be configured to act as a double-pole, double-throw switch.

As shown in FIG. 1D, in some implementations, by receiving the downwardly extending cylindrical feature of the conductive insert 120 therein, the bore 114 of the dome 110 in conjunction with the bore 132 of the insulator 130 may be configured to prevent lateral movement of the conductive insert 120. In some implementations, the bore 114 of the dome 110 in conjunction with the bore 132 of the insulator 130 may not be configured to prevent the lateral movement of the conductive insert 120 (not shown).

In some implementations, the dome 110 and/or the conductive insert 120 may be made of a stainless steel and/or another conductive material suitable for use as part of a multi-pole dome switch 100. In some implementations, the dome and/or the conductive insert 120 may be plated with a conductive material (e.g., nickel, gold, and/or silver).

In some implementations, the insulator 130 may be made of any non-conductive material (e.g., nylon) suitable for preventing current from traveling between the dome 110 and the conductive insert 120 of a multi-pole dome switch 100.

In some implementations, the non-conductive tape may be made of a polyester material and/or any other non-conductive material known to one of ordinary skill in the art that is suitable for use as part of a multi-pole dome switch 100.

In some implementations, the multi-pole dome switch 100 may be configured to simultaneously, or nearly simultaneously, close or open three of more circuits. In this way, three or more separate electrical devices may be simultaneously, or nearly simultaneously, turned on or off.

Figure 2A:
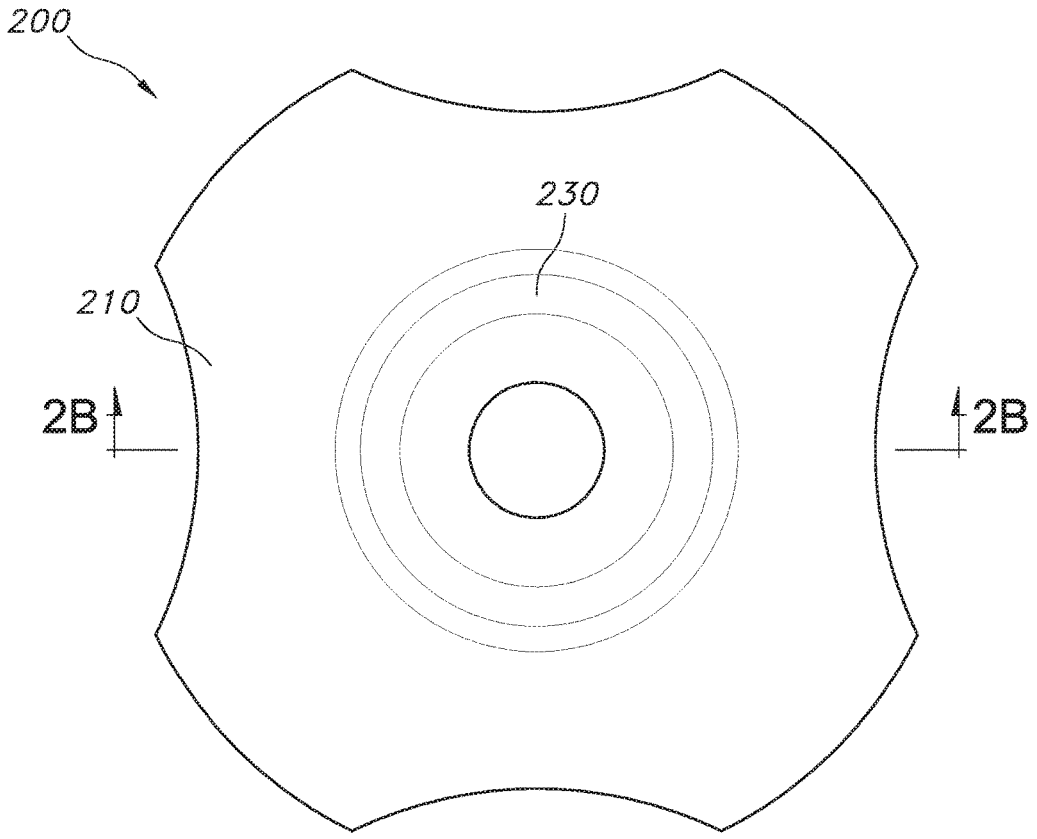
FIG. 2A illustrates a top plain view of another example implementation of a multi-pole dome switch according to the principles of the present disclosure.
Figure 2B:
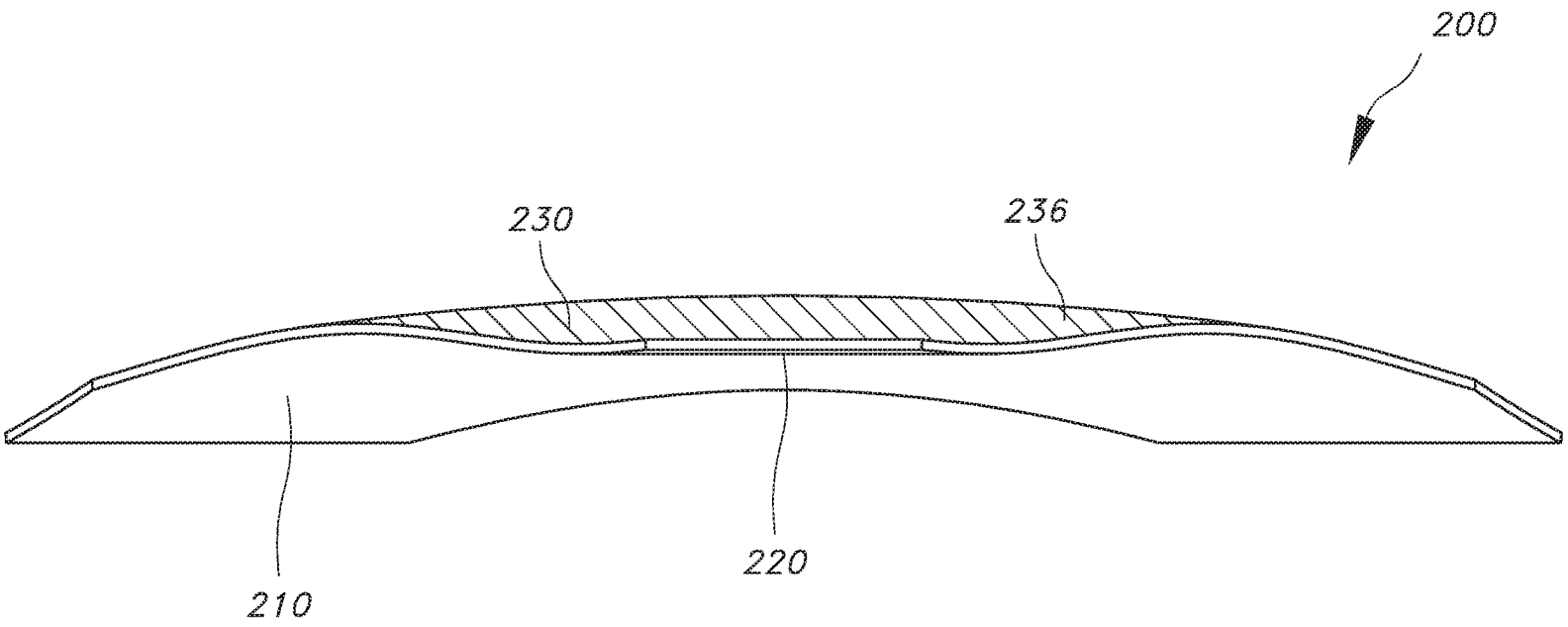
FIGS. 2B-2C illustrate cross-sectional views of the multi-pole dome switch shown in FIG. 2A.
Figure 2C:
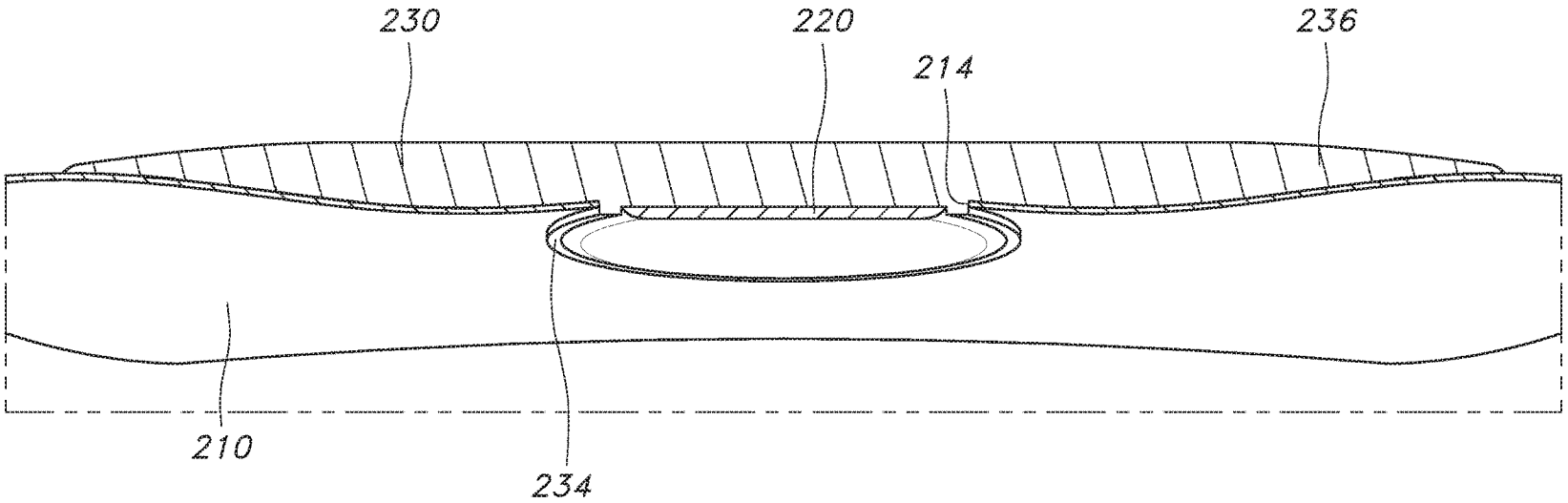

FIGS. 2A-2C illustrate another example implementation of a multi-pole dome switch 200 according to the principles of the present disclosure. In some implementations, the multi-pole dome switch 200 is similar to the multi-pole dome switch 100 discussed above but the conductive insert 220 (or contact) and the insulator 230 are a single unitary piece formed using an overmolding process.

In some implementations, the dome 210 of the multi-pole dome switch 200 may be the same as, or similar to, the dome 110 discussed above in connection with the multi-pole dome switch 100.

As shown in FIGS. 2B and 2C, in some implementations, the conductive insert 220 may be a circular contact area positioned on the underside of the insulator 230 so that it extends into and through the bore 214 of the dome 210. In this way, the contact area of the conductive insert 220 is able to conductively connect two traces (e.g., elements 108, 109 on the PCB 104) positioned thereunder when the dome 210 is depressed.

In some implementations, the conductive insert 220 may include an annular ledge extending from a top side thereof about which the material used to form the insulator 230 is molded. In this way, for example, the insulator 230 may be molded over an upper portion of the conductive insert 220 to thereby create a single unitary piece.

In some implementations, a conductive coating (e.g., gold, silver, and/or nickel plating) may be applied to the underside of the insulator 230 and used in-lieu of the molded in conductive insert 220.

As shown in FIGS. 2B and 2C, in some implementations, the insulator 230 may comprise a downwardly extending lip 234 and an annular flange 236.

As shown in FIG. 2C, in some implementation, the lip 234 of the insulator 230 may extend into the bore 214 of the dome 210 and be positioned between the conductive insert 220 and an interior edge of the bore 214. In this way, the lip 234 of the insulator 230 may be used to prevent a short circuit between the dome 210 and the conductive insert 220. In some implementations, the lip 234 may be flush with the underside of the dome 210 adjacent the bore 214 extending therethrough (see, e.g., FIG. 2C). In some implementations, the lip 234 may not be flush with the underside of the dome 210 adjacent the bore 214 extending therethrough (not shown).

As shown in FIGS. 2A and 2C, in some implementations, the annular flange 236 of the insulator 230 may be larger in diameter than the bore 214 extending through the dome 210. In this way, the conductive insert 220 and the insulator 230 may be prevented from falling through the bore 214 of the dome 210.

Therefore, in some implementations, when the dome 210 is depressed, the dome 210 and the contact area of the conductive insert 220 may be configured to simultaneously, or nearly simultaneously, make conductive contact with a first pair of traces (e.g., elements 106, 107) and a second pair of traces (e.g., elements 108, 109), respectively, positioned thereunder on a PCB (e.g., element 104). In this way, the multi-pole dome switch 200 is able to simultaneously, or nearly simultaneously, close two separate circuits.

Figure 3A:
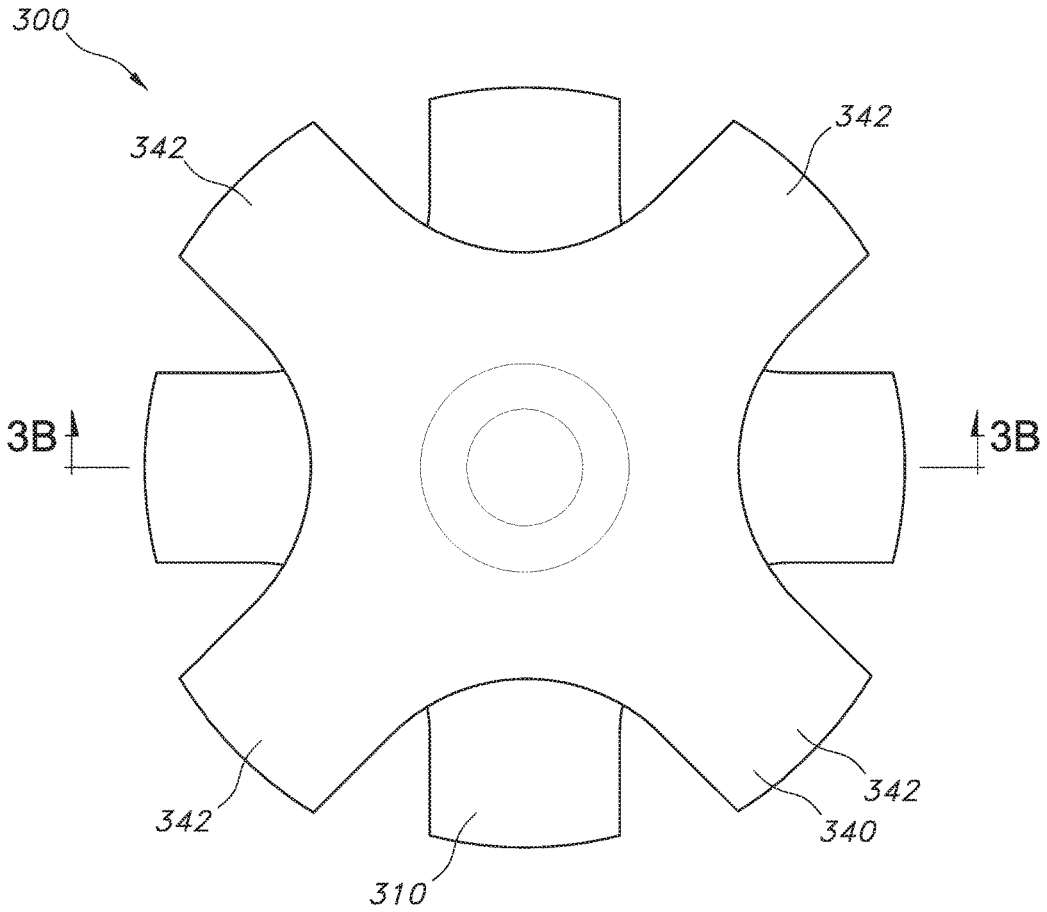
FIG. 3A illustrates a top plain view of yet another example implementation of a multi-pole dome switch according to the principles of the present disclosure.
Figure 3B:
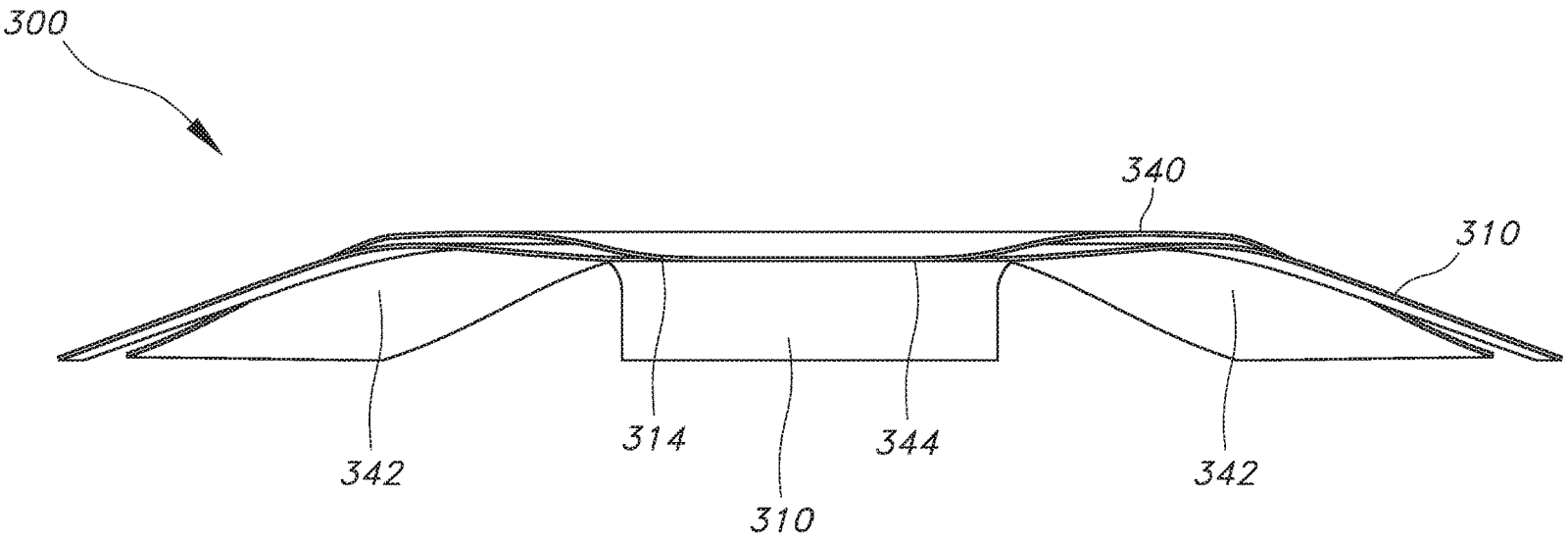
FIGS. 3B-3C illustrate cross-sectional views of the multi-pole dome switch shown in FIG. 3A.
Figure 3C:
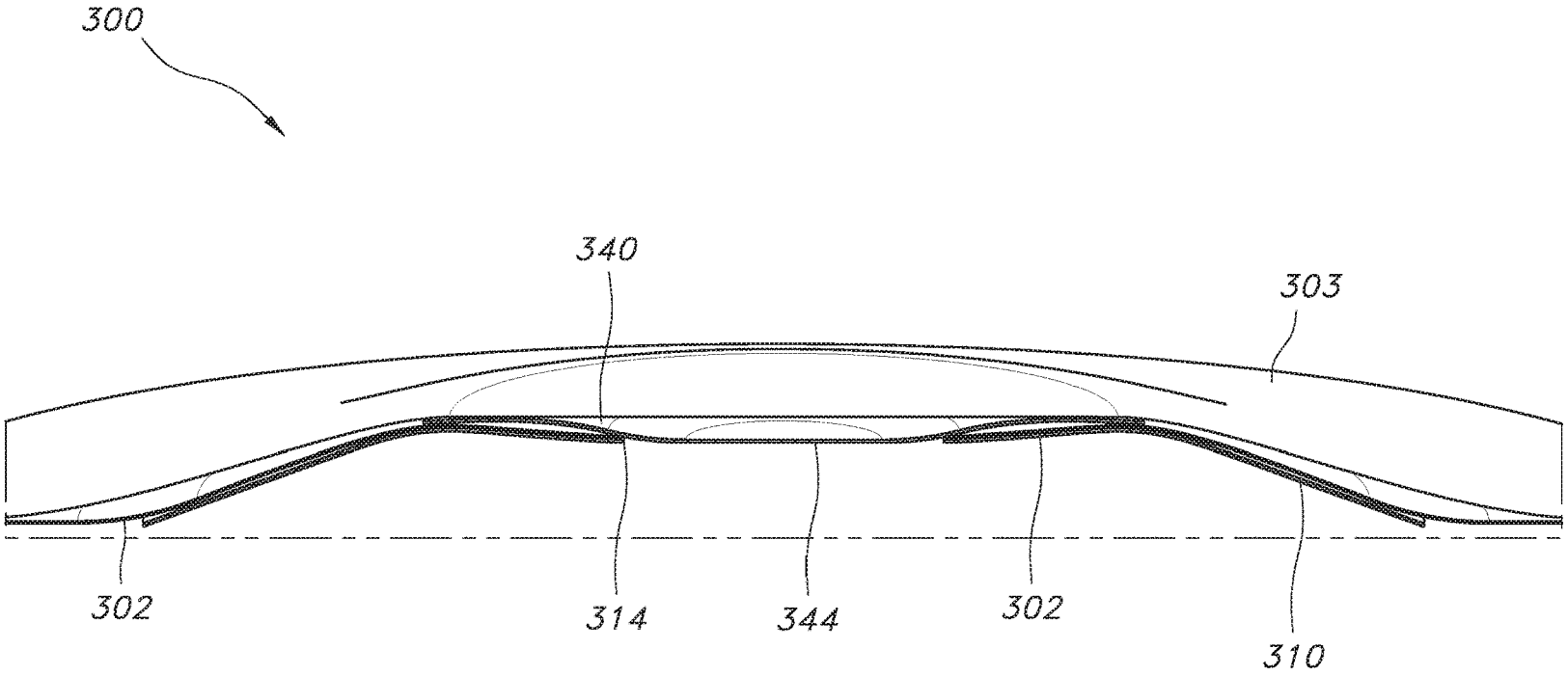

FIGS. 3A-3C illustrates yet another example implementation of a multi-pole dome switch 300 according to the principles of the present disclosure. In some implementations, the multi-pole dome switch 300 is similar to the multi-pole dome switches 100, 200 discussed above but the multi-pole dome switch 300 switch is comprised of a first dome 310 and a second dome 340 separated by a first non-conductive tape 302 (e.g., a pressure sensitive adhesive tape). In some implementations, the second dome 340 may be axially offset 45 degrees from the first dome 310 (see, e.g., FIG. 3A). In some implementations, the second dome 340 may not be axially offset 45 degrees from the first dome 310 (not shown).

In some implementations, the first dome 310 of the multi-pole dome switch 300 may be the same as, or similar to, the dome 110 discussed above in connection with the multi-pole dome switch 100.

As shown in FIGS. 3A-3C, in some implementations, the second dome 340 may comprise four legs 342 and a centrally located downward protrusion 344 configured to extend through the centrally located bore 314 of the first dome 310. In some implementations, while the second dome 340 is depressed, the bottom portion (or contact) of the downward protrusion 344 may be configured to make conductive contact with two traces and thereby close a circuit.

In some implementations, the first non-conductive tape 302 (or insulator) may be positioned and configured to cover the first dome 310 and thereby prevent a short circuit between the first dome 310 and the second dome 340 of the multi-pole dome switch 300. In some implementations, the first tape 302 may include a centrally located bore that extends therethrough.

In some implementations, the first tape 302 may be configured so that a portion thereof adjacent the bore extends into the bore 314 of the dome 310 and is thereby positioned between the downward protrusion 344 of the second dome 340 and an interior edge of the bore 314. In this way, the first tape 302 may be further configured to prevent a short circuit. In some implementations, the first tape 302 may not be configured so that a portion thereof extends into the bore 314 of the first dome 310.

In some implementations, when the multi-pole dome switch 300 is assembled, the bore extending though the first tape 302 may be in coaxial alignment with the bore 314 extending through the first dome 310 (see, e.g., FIG. 3C). In this way, when the domes 310, 240 are depressed, the downward protrusion 344 of the second dome 340 is able to extend through the bore of the first tape 302 and the bore 314 of the first dome 310 to make conductive contact with two traces (e.g., elements 108, 109 on the PCB 104) and thereby close a circuit.

In some implementations, a second non-conductive tape 303 may be used to cover the multi-pole dome switch 300. In this way, the first dome 310, the first tape 302, and the second dome 340 of the multi-pole dome switch 300 may be held together as an assembly.

Therefore, in some implementations, when the second dome 340 is depressed, the first dome 310 and the second dome 340 may be configured to simultaneously, or nearly simultaneously, make conductive contact with a first pair of traces (e.g., elements 106, 107) and a second pair of traces (e.g., elements 108, 109), respectively, positioned thereunder on a PCB (e.g., element 104). In this way, the multi-pole dome switch 300 is able to simultaneously, or nearly simultaneously, close two separate circuits.

In some implementations, the first dome 310 and/or the second dome 340 may be made of a stainless steel and/or any other conductive material suitable for use as part of a multi-pole dome switch 300. In some implementations, the first dome 310 and/or the second dome 340 may be plated with a conductive material (e.g., nickel, gold, and/or silver).

In some implementations, the first and/or second non-conductive tapes 302, 303 may be made of a polyester material and/or any other non-conductive material known to one of ordinary skill in the art that is suitable for use as part of a multi-pole dome switch 300.

As shown in FIGS. 1A-1D, 2A-2C, and 3A-3C, each multi-pole dome switch 100, 200, 300 may be configured to operate as a pressure actuable "MOMENTARY ON" switch. In these implementations, two separate circuits may be simultaneously, or nearly simultaneously, closed when pressure is applied to the dome(s) 110, 210, 310 and 340 and simultaneously, or nearly simultaneously, opened when pressure is removed therefrom.

In some implementations, a multi-pole dome switch 100, 200, 300 may be configured to operate as a pushbutton actuable "CONSTANT ON or OFF" switch (not shown). In such implementations, the two separate circuits remain closed until pressure is applied and then removed from the dome 110, 210, 310, 340 a second time.

In some implementations, a multi-pole dome switch 100, 200, 300 may be adapted for use on a flexible circuit (or flexible printed circuit board) and/or used as part of a membrane switch.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A multi-pole dome switch configured to be positioned on a printed circuit board having a first circuit and a second circuit, the multi-pole dome switch comprising:

a conductive dome configured to make conductive contact with a first trace and a second trace of the first circuit when depressed, the conductive dome comprises a centrally located opening that extends therethrough;

a conductive insert, the conductive insert comprises a downwardly extending feature having a contact portion, the downwardly extending feature of the conductive insert is configured to extend through the centrally located opening of the conductive dome and position the contact portion thereof to conductively connect a first trace and a second trace of the second circuit when the conductive dome is depressed; and an insulator positioned between the conductive dome and the conductive insert, the insulator is configured to prevent contact between the conductive dome and the conductive insert.

2. The multi-pole dome switch of claim 1, wherein the conductive dome further comprises a downwardly curved contact portion that makes conductive contact with the second trace of the first circuit when the conductive dome is depressed, the downwardly curved contact portion is an annular feature that encircles the centrally located opening of the conductive dome.

3. The multi-pole dome switch of claim 2, wherein the insulator comprises an opening defined by a downwardly extending lip, the opening of the insulator is in coaxial alignment with the centrally located opening of the conductive dome, the lip of the insulator extends into the centrally located opening of the conducive dome and thereby prevents contact between the downwardly extending feature of the conductive insert and the centrally located opening of the conductive dome.

4. The multi-pole dome switch of claim 1, wherein the insulator comprises an opening defined by a downwardly extending lip, the opening of the insulator is in coaxial alignment with the centrally located opening of the conductive dome, and the lip of the insulator extends into the centrally located opening of the conducive dome and thereby prevents contact between the downwardly extending feature of the conductive insert and the centrally located opening of the conductive dome.

5. The multi-pole dome switch of claim 1, further comprising a non-conductive tape that is used to cover, and hold together as an assembly, the conductive dome, the conductive insert, and the insulator.

6. The multi-pole dome switch of claim 1, wherein the conductive dome further comprises four legs, each of the four legs is configured to be placed into conductive contact with the first trace of the first circuit.

7. The multi-pole dome switch of claim 1, wherein the insulator further comprises an annular flange that is resting on a top side of the conductive dome, the annular flange of the insulator is larger in diameter than an annular flange of the conductive insert resting thereon.

8. A multi-pole dome switch configured to be positioned on a printed circuit board having a first circuit and a second circuit, the multi-pole dome switch comprising:

a conductive dome configured to make conductive contact with a first trace and a second trace of the first circuit when depressed, the conductive dome comprises a centrally located opening that extends therethrough; and an insulator having a conductive insert positioned on an underside thereof, the insulator is configured to prevent contact between the conductive insert thereon and the conductive dome, a portion of the insulator extends through the centrally located opening of the conductive dome and positions the conductive insert thereon to conductively connect a first trace and a second trace of the second circuit when the conductive dome is depressed.

9. The multi-pole dome switch of claim 8, wherein the conductive dome further comprises a downwardly curved contact portion that makes conductive contact with the second trace of the first circuit when the conductive dome is depressed, the downwardly curved contact portion is an annular feature that encircles the centrally located opening of the conductive dome.

10. The multi-pole dome switch of claim 9, wherein the portion of the insulator that extends through the centrally located opening of the conductive dome includes a lip thereon that is positioned between the conductive insert and an interior edge of the centrally located opening of the conductive dome.

11. The multi-pole dome switch of claim 8, wherein the portion of the insulator that extends through the centrally located opening of the conductive dome includes a lip thereon that is positioned between the conductive insert and an interior edge of the centrally located opening of the conductive dome.

12. The multi-pole dome switch of claim 8, further comprising a non-conductive tape that is used to cover, and hold together as an assembly, the conductive dome and the insulator.

13. The multi-pole dome switch of claim 8, wherein the conductive insert includes an annular ledge extending from a top side thereof about which the insulator is molded.

14. The multi-pole dome switch of claim 8, wherein the conductive dome further comprises four legs, each of the four legs is configured to be placed into conductive contact with the first trace of the first circuit.

15. A multi-pole dome switch configured to be positioned on a printed circuit board having a first circuit and a second circuit, the multi-pole dome switch comprising:

a first conductive dome configured to make conductive contact with a first trace and a second trace of the first circuit when depressed, the conductive dome comprises a centrally located opening that extends therethrough;

a second conductive dome, the second conductive dome comprises a centrally located downward protrusion, the centrally located downward protrusion is configured to extend through the centrally located opening of the first conductive dome and position a bottom portion thereof to conductively connect a first trace and a second trace of the second circuit when the second conductive dome is depressed; and an insulator positioned between the first conductive dome and the second conductive dome that is configured to prevent contact between the first conductive dome and the second conductive dome;

wherein the multi-pole dome switch is configured so that depressing the second conductive dome depresses the first conductive dome.

16. The multi-pole dome switch of claim 15, wherein the first conductive dome further comprises a downwardly curved contact portion that makes conductive contact with the second trace of the first circuit when the first conductive dome is depressed, the downwardly curved contact portion is an annular feature that encircles the centrally located opening of the first conductive dome.

17. The multi-pole dome switch of claim 16, wherein a portion of the insulator extends into the centrally located opening of the first conductive dome, is positioned between the downward protrusion of the second conductive dome and an interior edge of the centrally located opening of the first conductive dome, and thereby prevents contact between the downward protrusion of the second conductive dome and the centrally located opening of the first conductive dome.

18. The multi-pole dome switch of claim 15, wherein a portion of the insulator extends into the centrally located opening of the first conductive dome, is positioned between the downward protrusion of the second conductive dome and an interior edge of the centrally located opening of the first conductive dome, and thereby prevents contact between the downward protrusion of the second conductive dome and the centrally located opening of the first conductive dome.

19. The multi-pole dome switch of claim 15, further comprising a non-conductive tape that is used to cover, and hold together as an assembly, the first conductive dome, the second conductive dome, and the insulator.

20. The multi-pole dome switch of claim 15, wherein the first conductive dome further comprises four legs, each of the four legs is configured to be placed into conductive contact with the first trace of the first circuit.

* * * * *